US006918821B2

(12) United States Patent
Balijepalli et al.

(10) Patent No.: US 6,918,821 B2
(45) Date of Patent: Jul. 19, 2005

(54) MATERIALS AND METHODS FOR LOW PRESSURE CHEMICAL-MECHANICAL PLANARIZATION

(75) Inventors: Sudhakar Balijepalli, Midland, MI (US); Dale J. Aldrich, Lake Jackson, TX (US); Laura A. Grier, Brazoria, TX (US); Michael E. Mills, Midland, MI (US)

(73) Assignee: Dow Global Technologies, Inc., Midland, MI (US)

( * ) Notice: Subject to any disclaimer, the term of this patent is extended or adjusted under 35 U.S.C. 154(b) by 0 days.

(21) Appl. No.: 10/704,982

(22) Filed: Nov. 12, 2003

(65) Prior Publication Data

US 2005/0101227 A1 May 12, 2005

(51) Int. Cl.[7] ..... B24B 1/00
(52) U.S. Cl. ..... 451/41; 451/57
(58) Field of Search ..... 451/41, 56, 60, 451/57, 58

(56) References Cited

U.S. PATENT DOCUMENTS 6,019,670 A * 2/2000 Cheng et al. ..... 451/56
6,685,540 B2 * 2/2004 Cherian et al. ..... 451/41
2003/0013387 A1 * 1/2003 Tsai et al. ..... 451/41

* cited by examiner

*Primary Examiner*—Dung Van Nguyen
(74) *Attorney, Agent, or Firm*—Harness, Dickey & Pierce, P.L.C.

(57) ABSTRACT

Provided are materials and methods for the chemical mechanical planarization of material layers using a down force of less than about 2.5 psi while maintaining a material removal rate generally similar to that obtained using higher down forces while simultaneously improving the selectivity of the process with respect to a primary material formed over a barrier material. The materials and methods disclosed herein are suitable for use in meatallization operations during semiconductor device fabrication, in particular in processes in which the primary material is a softer metal such as copper and the barrier material is a harder material such as a metal nitride.

23 Claims, 6 Drawing Sheets

MATERIALS AND METHODS FOR LOW PRESSURE CHEMICAL-MECHANICAL PLANARIZATION

TECHNICAL FIELD

The present invention relates generally to materials and methods for planarizing semiconductor substrates and, in particular, to methods of removing process material layers from the surface of semiconductor substrates using fixed abrasive pads at low pressure and with high selectivity.

BACKGROUND

Ultra large scale integrated (ULSI) semiconductor devices, such as dynamic random access memories (DRAMs) and synchronous dynamic random access memories (SDRAMs), consist of multiple layers of conducting, semiconducting, and insulating materials, interconnected within and between layers in specific patterns designed to produce desired electronic functionalities. The materials are selectively patterned on each layer of the device, using lithographic techniques, typically by depositing one or more layers, patterning or masking the layers, and then etching the exposed portions of the materials.

Semiconductor device manufacturing is a very precise process, particularly as the size of the device structures continues to decrease and the complexity of the circuits continues to increase. Height differences, pitch and reflectivity variations and other imperfections present in the surface of underlying layers may compromise the formation of additional process layers and/or the ability to precisely position and dimension photoresist patterns formed during subsequent lithography processes.

A variety of methods have been developed in the art so as to increase the plurality of the layers during the manufacturing process. Such methods include reflow processes with deposited oxides, spin-on-glass (SOG) processes, etchback processes and Chemical-Mechanical Planarization (CMP) processes (also referred to as Chemical-Mechanical Polishing). CMP processes have been developed for removing a wide variety of materials including oxides, nitrides, suicides and metals from the surface of a semiconductor substrate. As used herein, the terms planarization and polishing are intended to be mutually inclusive terms for the same general category of processes.

A variety of different machine configurations have been developed for performing the various CMP processes. Machines used for CMP processing can be broadly grouped into either web-feed or fixed-pad categories. In both categories, however, the basic process uses a combination of a planarizing pad and a planarizing liquid to remove material from the surface of a semiconductor substrate using primarily mechanical action or through a combination of chemical and mechanical action.

The planarizing pads, in turn, can be broadly grouped into fixed-abrasive (FA) or non-abrasive (NA) categories. In fixed-abrasive pads, abrasive particles are distributed in material that forms at least a portion of the planarizing surface of the pad, while non-abrasive pad compositions do not include any abrasive particles. Because the fixed-abrasive pads already include abrasive particles, they are typically used in combination with a "clean" planarizing liquid that does not add additional abrasive particles.

With non-abrasive pads, however, substantially all of the abrasive particles used in the planarizing process are introduced as a component of the planarizing liquid, typically as a slurry applied to the planarizing surface of the pad. Both the "clean" and abrasive planarizing liquids can also include other chemical components, such as oxidizers, surfactants, viscosity modifiers, acids and/or bases in order to achieve the desired liquid properties for the removal of the targeted material layer from the semiconductor substrate and/or to provide lubrication for decreasing defectivity rates.

CMP processes typically utilize a combination of mechanical abrasion and chemical reaction(s) provided by the action of the planarizing slurry or planarizing liquid and a planarizing pad in order to remove one or more materials from a wafer surface and produce a substantially planar wafer surface. Planarizing slurries used in combination with non-abrasive pads, particularly for the removal of oxide layers, generally comprise a basic aqueous solution of a hydroxide, such as KOH, containing abrasive silica particles. Planarizing slurries, particularly for the removal of metal layers such as copper, generally comprise an aqueous solution of one or more oxidizers, such as hydrogen peroxide, to form the corresponding metal oxide that is then removed from the substrate surface.

The planarizing pads used in such processes typically comprise porous or fibrous materials, such as polyurethanes, that provide a relatively compliant surface onto which the planarizing slurry may be dispensed. The consistency of a CMP process may be greatly improved by automating the process so that the planarizing is terminated in response to a consistently measurable endpoint reflecting sufficient removal of an overlying material layer, typically followed by a brief "overetch" or "over-polish" to compensate for variations in the thickness of the material layer.

The size and concentration of the particles for planarizing a wafer surface can directly affect the resulting surface finish and the productivity of a CMP process. For example, if the abrasive particulate concentration is too low or the abrasive particle size too small, the material removal rate will generally slow and process throughput will be reduced. Conversely, if the abrasive particulate concentration is too high, the abrasive particles are too large or the abrasive particles begin to agglomerate, the wafer surface is more likely to be damaged, the CMP process may tend to become more variable and/or the material removal rate may decrease, resulting in reduced throughput, reduced yields or device reliability and/or increased scrap.

CMP processes may experience significant performance variations over time that further complicate processing of the wafers and reduce process throughput. In many cases, the performance variations may be attributable to changes in the characteristics of the planarizing pad as a result of the CMP process itself. Such changes may result from particulates agglomerating and/or becoming lodged in or hardening on the pad surface. Such changes may also be the result of wear, glazing or deformation of the pad, or simply the degradation of the pad material over time.

In a typical planarizing process, the planarizing machine brings the non-planar surface of a material layer formed over one or more patterns on a semiconductor substrate into contact with a planarizing surface of the planarizing pad. During the planarizing process, the surface of the planarizing pad will typically be continuously wetted with an abrasive slurry and/or a planarizing liquid to produce the desired planarizing surface. The substrate and/or the planarizing surface of the pad are then urged into contact and moved relative to one another to cause the planarizing surface to begin removing an upper portion of the material layer. This relative motion can be simple or complex and may include one or more lateral, rotational, revolving or orbital movements by the planarizing pad and/or the substrate in order to produce generally uniform removal of the material layer across the surface of the substrate.

As used herein, lateral movement is movement in a single direction, rotational movement is rotation about an axis through the center point of the rotating object, revolving movement is rotation of the revolving object about a non-centered axis and orbital movement is rotational or revolving movement combined with an oscillation. Although, as noted above, the relative motion of the substrate and the planarizing pad may incorporate different types of movement, the motion must typically be confined to a plane substantially parallel to the surface of substrate in order to achieve a planarized substrate surface.

Fixed abrasive pad types are known in the art of semiconductor wafer processing and have been disclosed in, for example, U.S. Pat. No. 5,692,950 to Rutherford et al.; U.S. Pat. No. 5,624,303 to Robinson; and U.S. Pat. No. 5,335,453 to Baldy et al. These types of fixed abrasive pads typically require a pre-conditioning cycle before they may be used in a CMP process, as well as periodic re-conditioning or in-situ surface conditioning during use, to generate a suitable number of asperities on the planarizing surface to maintain their planarizing ability.

The primary goal of CMP processing is to produce a defect-free planarized substrate surface having a material layer, or portions of a material layer, of uniform depth across the entire surface of the planarized substrate. Other goals, such as maximizing the throughput of the CMP process and reducing the per wafer cost, may, at times, conflict with the production of the best possible planarized surface. The uniformity of the planarized surfaces and the process throughput are directly related to the effectiveness and repeatability of the entire CMP process including the planarizing liquid, the planarizing pad, machine maintenance, as well as an array of other operating parameters. A variety of planarizing slurries and liquids have been developed that are somewhat specific to the composition of the material layer or layers that are to be removed and/or the composition of the planarizing pad being used. These tailored slurries and liquids are intended to provide adequate material removal rates and selectivity for particular CMP processes.

The benefits of CMP may be somewhat offset by the variations inherent in such a combination process, such as imbalances that may exist or may develop between the chemical and mechanical material removal rates of different material layers exposed on a single semiconductor substrate. Further, both the abrasive particles and other chemicals used in a typical CMP process may be relatively expensive and are generally unsuitable for reuse or recycling. This problem is compounded by the need to supply excess materials to the surface of the planarization pad to ensure that sufficient material is available at every point of the wafer surface as it moves across the pad. It is therefore desirable to reduce the quantity of abrasives and other chemicals used in a CMP process in order to reduce costs associated with both purchasing and storing the materials prior to use and the concerns and expense relating to the disposal of the additional waste materials.

A number of efforts toward reducing the variability and increasing the quality of CMP processes have been previously disclosed. For instance, U.S. Pat. No. 5,421,769 to Schultz et al. discloses a noncircular planarizing pad intended to compensate for variations resulting from the edges of a rotating wafer traveling across more of a planarizing pad than the interior surfaces. U.S. Pat. No. 5,441,598 to Yu et al. discloses a planarizing pad having a textured planarizing surface for providing a planarizing surface intended to provide more even polishing of wide and narrow structures across a wafer surface. U.S. Pat. No. 5,287,663 to Pierce et al. discloses a composite planarizing pad with a rigid layer opposite the planarizing surface and a resilient layer adjacent the rigid layer to reduce overplanarization, or "dishing," of material from between harder underlying features. Each of the above references, in its entirety, is incorporated by reference in this disclosure.

Other prior art efforts to minimize uneven planarization of wafers have focused on forming additional material layers on the wafer surface to act as "stop" layers to control overplanarization. U.S. Pat. Nos. 5,356,513 and 5,510,652 to Burke et al. and U.S. Pat. No. 5,516,729 to Dawson et al. all provide additional material layers having an increased resistance to the CMP process under the layer being removed to protect the underlying circuit structures. These additional material layers, however, both complicate the semiconductor manufacturing process flow and, as recognized by Dawson et al., do not completely overcome the problem of "dishing." Each of the above references, in its entirety, is incorporated by reference in this disclosure.

More recent efforts regarding planarizing pad compositions and constructions are disclosed in U.S. Pat. No. 6,425,815 B1 to Walker et al. (a dual material planarizing pad), U.S. Pat. No. 6,069,080 to James et al. (a fixed abrasive pad with a matrix material having specified properties), U.S. Pat. No. 6,454,634 B1 to James et al. (a multiphase self-dressing planarizing pad), WO 02/22309 A1 to Swisher et al. (a planarizing pad having particulate polymer in a cross-linked polymer binder), U.S. Pat. No. 6,368,200 B1 to Merchant et al. (a planarizing pad of a closed cell elastomer foam), U.S. Pat. No. 6,364,749 B1 to Walker (planarizing pad having polishing protrusions and hydrophilic recesses), U.S. Pat. No. 6,099,954 to Urbanavage et al. (elastomeric compositions with fine particulate matter) and U.S. Pat. No. 6,095,902 to Reinhardt (planarization pads manufactured from both polyester and polyether polyurethanes). Each of the above references, in its entirety, is incorporated by reference in this disclosure.

Conventional polishing of metallic and non-metallic substrates during the manufacture of semiconductor devices are typically conducted at downward pressures (also referred to as downforce) of at least about 3 psi (0.21 kg/cm$^2$) and may range as high as 6 psi (0.42 kg/cm$^2$) or more in order to achieve acceptable removal rates. However, although the increased downward pressure does result in increased removal rates, it also increases the likelihood of generating defects such as dishing, erosion and scratches in the wafers being polished, resulting in an increased scrap rate and a reduced yield rate for the wafers that survive the process. The increased downward pressure also tends to reduce the selectivity of the polish between different materials that may be present on the substrate being polished, thereby increasing the difficulty of completely removing the intended portion of the layer(s) without also removing a portion of the underlying layers as well. As noted above, this lack of selectively has led to the use of additional harder barrier or "stop" layers to protect the underlying structures, further complicating the manufacturing process to provide for the deposition and removal of these additional layers.

BRIEF SUMMARY OF THE INVENTION

The present invention provides materials and methods useful in the manufacture of semiconductor devices, specifically materials and methods for planarizing one or more layers deposited or formed on a semiconductor substrate, comprising removing material from a major surface of a substrate by applying a carrier liquid to a polishing surface of a polishing pad, the polishing pad including a fixed abrasive material having an open cell structure of a thermoset polymer matrix defining a plurality of interconnected cells and abrasive particles distributed throughout the polymer matrix; causing relative motion between the substrate and the polishing pad in a plane generally parallel to the major surface of the substrate while applying a first force, the first force tending to bring the major surface and the polishing surface into contact; conditioning the polishing surface by causing relative motion between a conditioning element and the polishing pad in a plane generally parallel to the major surface of the substrate while applying a second force, the second force tending to bring the conditioning element and the polishing surface into contact, thereby releasing free abrasive particles from the fixed abrasive material; and polishing the major surface of the substrate with the free abrasive particles to remove a portion of the material from the major surface of the substrate; wherein the first force is no greater than about 2.5 psi (0.18 kg/cm$^2$).

Although the type of material that may be removed from the substrate may include any material used in the manufacture of semiconductor devices, it is anticipated that this particular method is especially suitable for use during metallization processing for removing conductor and barrier materials, whether present as layers or patterns, including Cu, W, WN, Ta, TaN, Ti, TiN, Ru and RuN. The abrasive particles incorporated in the polishing pad, and released from the pad in combination with the polymer matrix during the conditioning step, may include one or more particulate materials selected from a group consisting of alumina, ceria, silica, titania and zirconia having an average particle size of less than about 2 $\mu$m, and preferably less than about 1 $\mu$m, and may constitute between about 20 weight percent and about 70 weight percent of the fixed abrasive material.

The polishing pad is subjected to in-situ conditioning during the operation of the exemplary methods, the conditioning process preferably being substantially continuous and operating to remove from about 0.01 to about 0.5 $\mu$m of the fixer abrasive material from the polishing surface of the polishing pad for each substrate polished. The fixed abrasive material may be characterized by a range of properties including a density between about 0.5 and about 1.2 gram per cm$^3$; a Shore A hardness between about 30 and about 90; a percent rebound at 5 psi of between about 30 and about 90; and a percent compressibility at 5 psi of between about 1 and 10, but will preferably have a density between about 0.75 and about 0.95 gram per cm$^3$; a Shore A hardness between about 75 and about 85; a percent rebound at 5 psi of between about 50 and about 75; and a percent compressibility at 5 psi of between about 2 and 4. The carrier liquid applied to the surface of the polishing pad during the polishing operation will be substantially free of abrasive, but will typically include one or more materials selected from a group consisting of acids, oxidizers, bases, chelating agents and surfactants.

It should be noted that the graphs and illustrations of the Figures are intended to show the general characteristics of methods and materials of exemplary embodiments of this invention, for the purpose of the description of such embodiments herein. These graphs and illustrations may not precisely reflect the characteristics of any given embodiment, and are not necessarily intended to fully define or limit the range of values or properties of embodiments within the scope of this invention.

DETAILED DESCRIPTION OF THE INVENTION

Described below and illustrated in the accompanying drawings are certain exemplary embodiments according to the invention. These exemplary embodiments are described in sufficient detail to enable those of skill in the art to practice the invention, but are not to be construed as unduly limiting the scope of the following claims. Indeed, those of skill in the art will readily appreciate that other embodiments may be utilized and that process or mechanical changes may be made without departing from the spirit and scope of the inventions as described.

The present invention provides methods useful in the production of semiconductor devices. As referred to herein, such devices include any wafer, substrate or other structure comprising one or more layers comprising conducting, semiconducting, and insulating materials. The terms wafer and substrate are used herein in their broadest sense and include any base semiconductor structure such as metal-oxide-silicon (MOS), shallow-trench isolation (STI), silicon-on-sapphire (SOS), silicon-on-insulator (SOI), thin film transistor (TFT), doped and undoped semiconductors, epitaxial silicon, III–V semiconductor compositions, polysilicon, as well as other semiconductor structures at any stage during their manufacture.

Figure 1A:
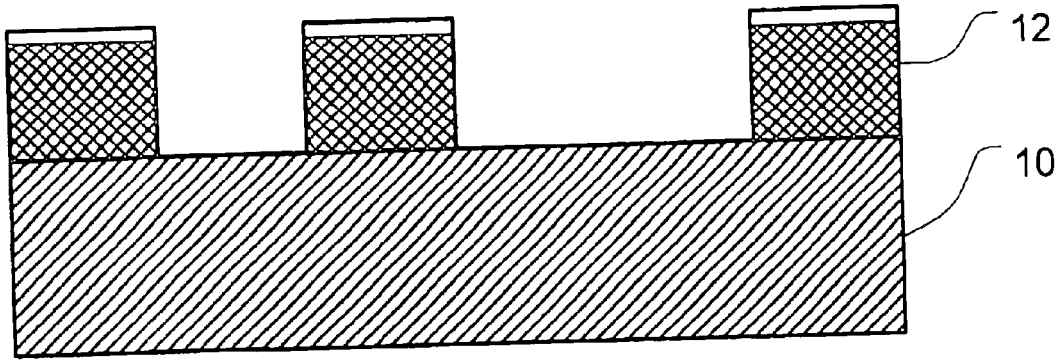
FIGS. 1A–C are cross-sectional views of a semiconductor substrate with a raised pattern, a material layer formed over the pattern, and the planarized substrate at sequential processing stages in accordance with an exemplary embodiment of the invention.
Figure 1B:
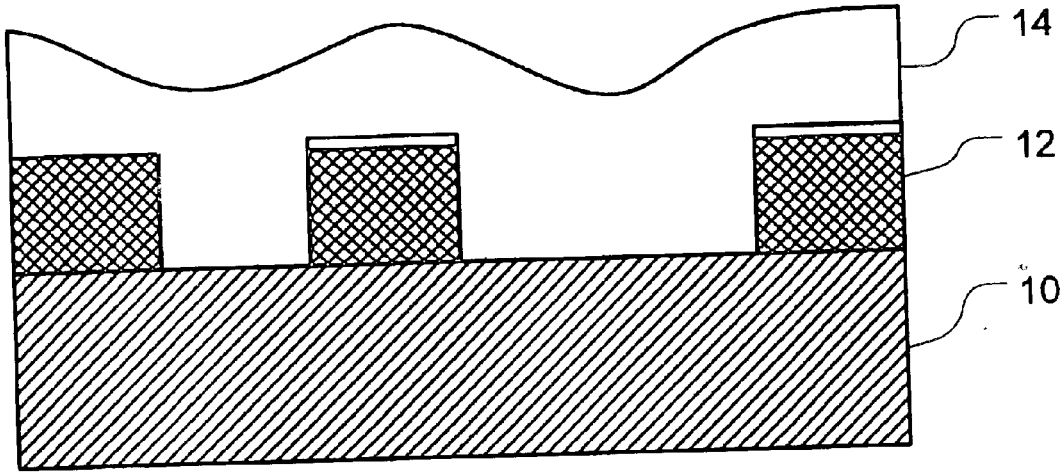

FIG. 1A illustrates a typical substrate having a first layer 10 and a patterned second layer 12. In typical semiconductor processing, first layer 10 may comprise a wafer of single-crystal silicon or other base semiconductor layer, an insulating layer separating second patterned layer 12 from other layers, or a combination of multiple layers formed during previous processing steps. As illustrated in FIG. 1B, a material layer 14, which may actually comprise multiple layers of one or more materials, is then typically formed or deposited over the patterned layer 12, producing a non-planar surface on the wafer.

If allowed to remain, this lack of planarity would present significant, if not fatal, process complications during subsequent processing steps. As a result, most, if not all, semiconductor manufacturing processes include one or more planarization processes such as spin-on-glass (SOG), etchback (or blanket etch) or chemical-mechanical planarization (CMP) in order to form a substantially planar surface before the wafer is subjected to additional processing.

Figure 1C:
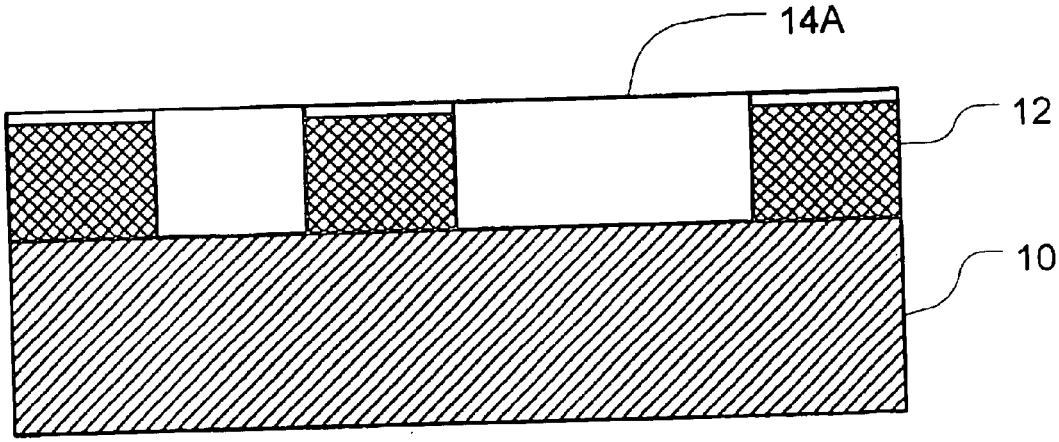

A typical CMP process will remove that portion of material layer 14 that lies over the patterned layer 12 while leaving that portion 14A of the material layer 14 that was deposited in the openings of patterned layer 12 to produce a substantially more planar surface as illustrated in FIG. 1C. Depending on the process, a stop layer comprising a more CMP resistant material may be incorporated on the upper surface of the patterned layer 12 to protect the underlying pattern during the planarization process. The actual composition and structure of the first layer 10, second layer 12 and the material layer 14 may comprise any combination of semiconductor, insulator or conductor materials assembled during the manufacture of a semiconductor device.

Figure 2A:
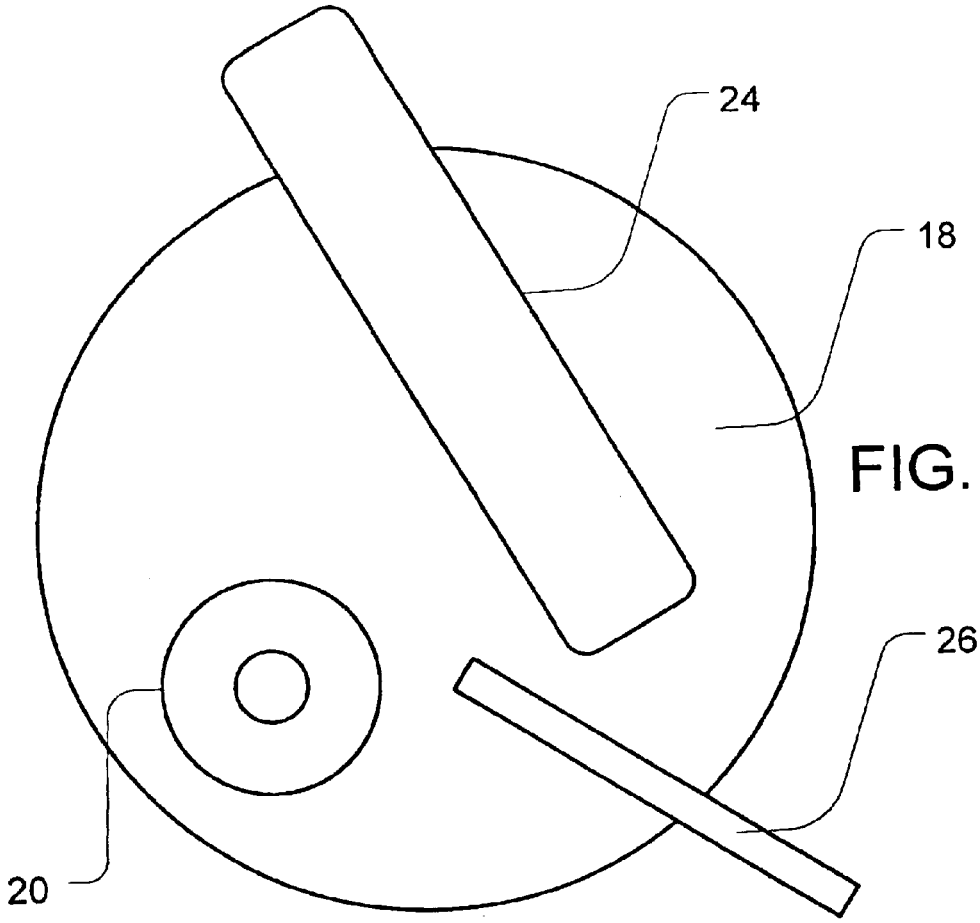
FIGS. 2A–B are a plan view and a side view of a planarization apparatus that may be used for planarizing substrates using planarizing pads incorporating a fixed abrasive material according to exemplary embodiments of the invention.
Figure 2B:
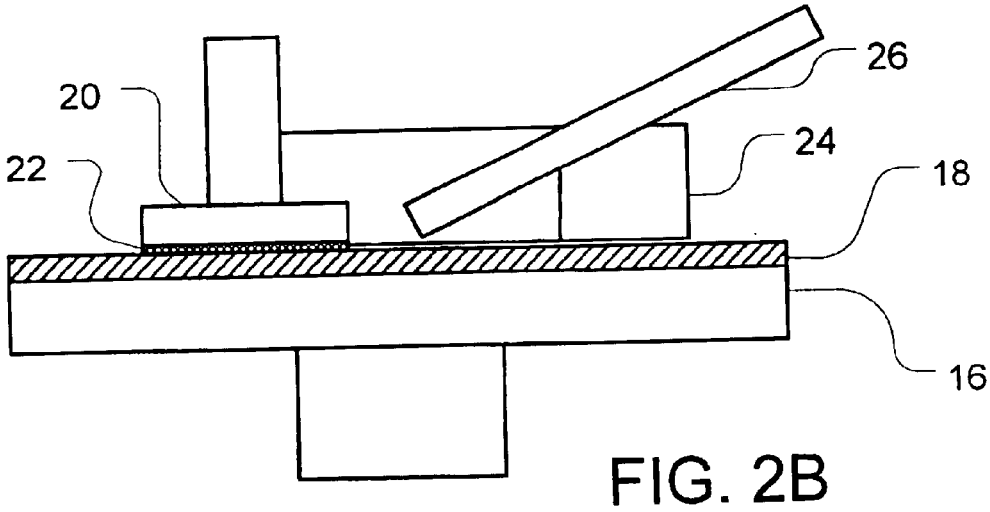

As illustrated in FIGS. 2A–B, a typical CMP apparatus for use with a fixed abrasive planarization pad will comprise at least a platen 16 supporting the planarizing pad 18, a wafer carrier 20 supporting a wafer 22 and positioning a major surface of the wafer adjacent a major surface of the planarizing pad 18, and a conditioning device 24 for conditioning the major surface of the planarizing pad and a carrier liquid supply line 26 for applying a carrier liquid to the major surface of the pad. The platen 16 and the wafer carrier 20 are configured to provide relative motion between the major surface of the planarizing pad 18 and the major surface of the wafer 22 while applying a force tending to move the wafer and the planarizing pad against each other.

The methods of this invention comprise the use of a polishing pad comprising a fixed abrasive material. The exemplary fixed abrasive materials have an open cell structure of a thermoset polymer matrix defining a plurality of interconnected cells and fine abrasive particles distributed fairly evenly throughout the polymer matrix. Fixed abrasive materials useful in the present invention are preferably manufactured from a polymeric composition comprising an aqueous dispersion or emulsion of one or more compositions such as polyurethanes, polyether polyols, polyester polyols, polyacrylate polyols and polystyrene/polyacrylate latexes. The polymeric composition may also include one or more additives including polymerization catalysts, chain extenders, including amines and diols, isocyanates, both aliphatic and aromatic, surfactants and viscosity modifiers.

An exemplary embodiment of a polyurethane dispersion useful for manufacturing a fixed abrasive material includes water, abrasive particles and a polyurethane (and/or a mixture capable of forming a polyurethane). The polyurethane dispersion will generally also include one or more additives such as surfactants, that may act as frothing aids, wetting agents and/or foam stabilizers, and viscosity modifiers. Polyurethane-forming materials may include, for example, polyurethane prepolymers that retain some minor isocyanate reactivity for some period of time after being dispersed, but as referenced herein, a polyurethane prepolymer dispersion will have reacted substantially completely to form a polyurethane polymer dispersion. Also, the terms polyurethane prepolymer and polyurethane polymer may encompass other types of structures such as, for example, urea groups.

Polyurethane prepolymers may be prepared by reacting active hydrogen compounds with an isocyanate, typically with a stoichiometric excess of the isocyanate. The polyurethane prepolymers may exhibit isocyanate functionality in an amount from about 0.2 to 20%, may have a molecular weight in the range of from about 100 to about 10,000, and are typically in a substantially liquid state under the conditions of the dispersal. The prepolymer formulations typically include a polyol component, e.g., active hydrogen containing compounds having at least two hydroxyl or amine groups. Exemplary polyols are generally known and are described in such publications as *High Polymers*, Vol. XVI, "Polyurethanes, Chemistry and Technology," Saunders and Frisch, Interscience Publishers, New York, Vol. I, pp. 32–42, 44–54 (1962) and Vol. II, pp. 5–6, 198–99 (1964); *Organic Polymer Chemistry*, K. J. Saunders, Chapman and Hall, London, pp. 323–25 (1973); and *Developments in Polyurethanes*, Vol. I, J. M. Burst, ed., Applied Science Publishers, pp. 1–76 (1978).

The polyurethane prepolymer dispersions may include a chain extender and/or cross-linker for increasing the molecular weight of the polyurethane. The polyurethane prepolymer dispersions may also include catalysts such as, for example, tertiary amines, organometallic compounds and mixtures thereof, and surfactants selected from cationic surfactants, anionic surfactants and non-ionic surfactants, as well as internal and external surfactants. The selection and use of surfactants, wetting agents and viscosity modifier compositions in polyurethane dispersions and other aspects of polyurethane manufacture, particularly with respect to polyurethane foams prepared by mechanical frothing, are addressed in U.S. Pat. Nos. 6,372,810 and 6,271,276, the contents of which are incorporated herein, in their entirety, by reference.

Polyurethane dispersions having a mean particle size of less than about 5 microns may be generally considered to be shelf-stable or storage-stable while polyurethane dispersions having a mean particle size greater than about 5 microns will tend to be less stable. Polyurethane dispersions may be prepared by mixing a polyurethane prepolymer with water and dispersing the prepolymer in the water using a mixer. Alternatively, the polyurethane dispersion may be prepared by feeding a prepolymer and water into a static mixing device, and dispersing the water and prepolymer in the static mixer. Continuous methods for preparing aqueous dispersions of polyurethane are also widely known as disclosed in, for example, U.S. Pat. Nos.: 4,857,565; 4,742,095; 4,879,322; 3,437,624; 5,037,864; 5,221,710; 4,237,264; 4,092,286 and 5,539,021, the contents of which are incorporated herein, in their entirety, by reference.

A polyurethane dispersion useful for forming an abrasive pad will generally include a polyurethane component, abrasive particles, and one or more surfactants to control the frothing and stabilize the resulting foam to produce a cured foam having a density between 350 $kg/m^3$ and 1200 $kg/m^3$ while maintaining desired foam properties like abrasion resistance, tensile, tear, and elongation (TTE), compression set, foam recovery, wet strength, toughness, and adhesion.

As will be appreciated by those of ordinary skill in the art, because certain of these various properties are interrelated, modifying one property will tend to effect the values of one or more of the other properties. One skilled in the art, however, guided by this disclosure can produce a range of compositions having a combination of values acceptable for various purposes.

Although the cured foam may have a density of between about 350 kg/m$^3$ and 1200 kg/m$^3$, preferred foams will have a density of about 600–1100 kg/m$^3$, more preferred foams will have a density of about 700–1000 kg/m$^3$ and most preferred foams will have a density of about 750–950 kg/m$^3$.

The polyurethane dispersion also comprises one or more abrasive particulate compositions. Such abrasive compositions may be either a dry powder or an aqueous slurry to produce a final polyurethane dispersion composition comprising between about 1 and 80 wt %, and more preferably between about 20 and 70 wt %, of the abrasive particulates. The abrasive particulates may comprise one or more fine abrasive materials, typically one or more inorganic oxides selected from a group consisting of silica, ceria, alumina, zirconia and titania and have an average particle size of between about 10 nm and 1 $\mu$m, preferably less than about 600 nm.

The polyurethane dispersion may also include viscosity modifiers, particularly thickeners, to adjust the viscosity of the polyurethane dispersion. Such viscosity modifiers include ACUSOL 810A (trade designation of Rohm & Haas Company), ALCOGUM™ VEP-II (trade designation of Alco Chemical Corporation) and PARAGUM™ 241 (trade designation of Para-Chem Southern, Inc.). Other suitable thickeners include cellulose ethers such as Methocel™ products (trade designation of The Dow Chemical Company). The viscosity modifiers may be present in the polyurethane dispersion in any amount necessary to achieve the desired viscosity, but are preferably present at less than 10 wt % and more preferably at less than 5 wt %.

The resulting polyurethane dispersion may have an organic solids content of up to about 60 wt %, an inorganic solids content, e.g., abrasive particles, of up to about 60 wt %, a viscosity of between about 500 and 50,000 cps, a pH of between about 4 and 11 and may include up to about 25 wt % surfactant(s). This polyurethane dispersion will also typically have an average organic particulate size of between about 10 nm and 50 $\mu$m, and preferably less than about 5 $\mu$m to improve its stability.

In order to produce a polyurethane foam from the polyurethane dispersion, the polyurethane dispersion is frothed, typically through the injection of one or more frothing agents, generally including one or more gases such as, for example, air, carbon dioxide, oxygen, nitrogen, argon and helium. The frothing agent(s) is typically introduced into the polyurethane dispersion by injecting the frothing agent, under pressure, into the polyurethane dispersion. A substantially homogeneous froth is then generated by applying mechanical shear forces to the polyurethane dispersion using a mechanical frother. In order to improve the homogeneity of the frothed composition, it is preferred that all components of the polyurethane dispersion, with the exception of the frothing agent, be mixed in a manner that does not incorporate excess quantities of gas into the dispersion prior to the frothing process. The mechanical frothing may be achieved with a variety of equipment, including frothers available from manufacturers including OAKES, COWIE & RIDING and FIRESTONE.

Once the polyurethane dispersion has been frothed, a layer of the frothed composition may be applied to a suitable substrate, such as a polycarbonate sheet or other polymeric material, using application equipment such as a doctor knife or roll, air knife, or doctor blade to apply and gauge the layer. See, for example, U.S. Pat. Nos. 5,460,873 and 5,948,500, the contents of which are hereby incorporated, in their entirety, by reference. The backing material or substrate may also be heated to a temperature between about 25 to 50° C. prior to the application of the frothed polyurethane dispersion.

After the frothed polyurethane dispersion is applied to the substrate, the froth is treated to remove substantially all of the water remaining in the froth and cure the polyurethane materials to form a resilient polyurethane foam having an open cell structure containing fine abrasive particles dispersed generally uniformly throughout the cell walls. The water is preferably removed at least partially by heating the froth and may use one or more energy sources such as an infrared oven, a conventional oven, microwave or heating plates capable of achieving temperatures of from about 50 to 200° C. The froth may also be cured by gradually increasing the temperature in a step-wise or continuous ramping manner. For example, curing a layer of the froth may comprise heating in three steps of approximately 30 minutes each at temperatures of about 70, 125 and 150° C. respectively.

The frothed polyurethane dispersion may be applied to the substrate to achieve a range of layer thicknesses and weights, ranging from about 1 kg/m$^2$ to about 14.4 kg/m$^2$ (about 3.3 oz/ft$^2$ to about 47.2 oz/ft$^2$) dry weight, depending on the characteristics of the substrate, the desired coating weight and the desired thickness. For example, for foams having a thickness between about 3 and 6 mm, the preferred coating weight is from about 2.1 kg/m$^2$ to about 5.7 kg/m$^2$ (about 6.9 oz/ft$^2$ to about 18.7 oz/ft$^2$) dry weight. For foams having a thickness of about 12 mm, the preferred coating weight is from about 9 kg/m$^2$ to about 11.4 kg/m$^2$ (about 29.5 oz/ft$^2$ to about 37.4 oz/ft$^2$) dry weight.

Other types of aqueous polymer dispersions may be used in combination with the polyurethane dispersions described above including styrene-butadiene dispersions; styrene-butadiene-vinylidene chloride dispersions; styrene-alkyl acrylate dispersions; ethylene vinyl acetate dispersions; polychloropropylene latexes; polyethylene copolymer latexes; ethylene styrene copolymer latexes; polyvinyl chloride latexes; or acrylic dispersions, like compounds, and mixtures thereof. Other components useful in preparing suitable aqueous polymer dispersions include polyols having acrylic groups or amine groups, acrylate prepolymers, expoxies, acrylic dispersions, acrylate dispersions and hybrid prepolymers.

The polyurethane foams produced by curing the frothed polyurethane dispersions described above are typically resilient open cell foams, i.e., foams that exhibit a resiliency of at least 5% when tested according to ASTM D3574. The polyurethane foams preferably exhibit a resiliency of from about 5 to 80%, more preferably from about 10 to 60%, and most preferably from about 15 to 50%, and a foam density between about 0.35 and 1.2 g/cm$^3$, preferably between about 0.7 and 1.0 g/cm$^3$, and most preferably between about 0.75 and 0.95 g/cm$^3$.

Figure 3A:
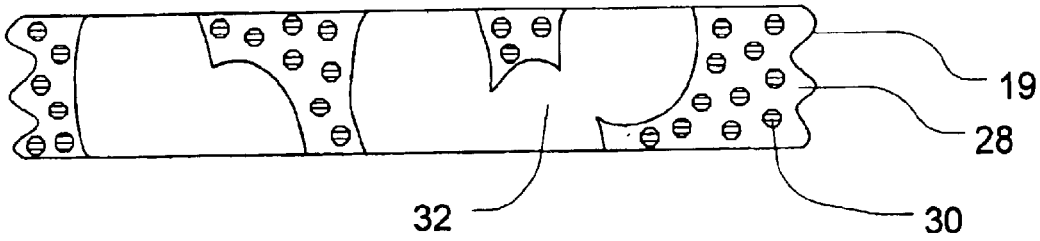
FIG. 3A is a cross-sectional view generally corresponding to a fixed abrasive material according to an exemplary embodiment of the invention.

As illustrated in FIG. 3A, the fixed abrasive material 19 comprises a polymeric material 28 containing a substantially uniform distribution of abrasive particles 30. The polymeric material has an open cell structure in which small adjacent cells 32 are randomly connected to one another to provide paths for fluid flow from the surface of the fixed abrasive material into and through the bulk of the fixed abrasive material.

Figure 3B:
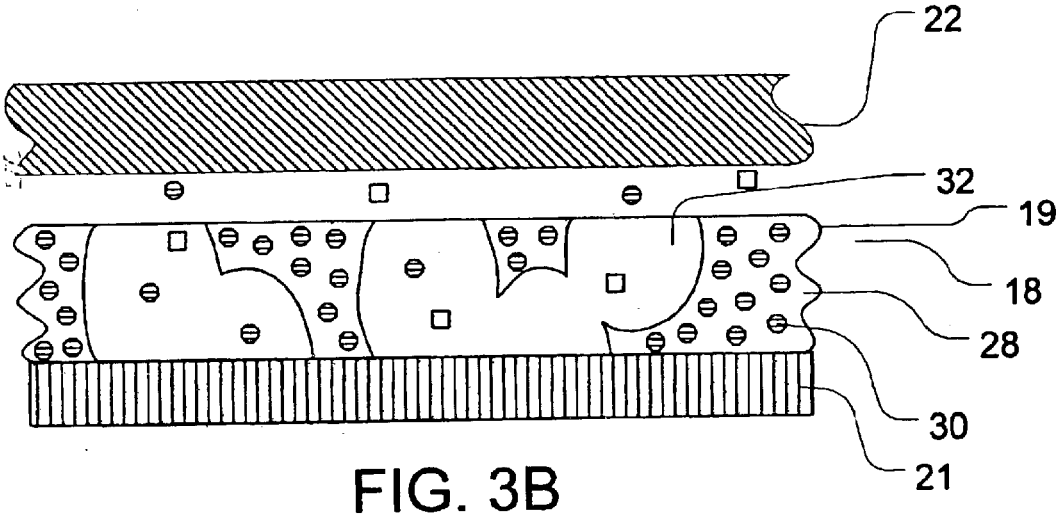
FIG. 3B is a cross-sectional view generally corresponding to a portion of a planarizing pad according to an exemplary embodiment of the invention without conditioning of the pad surface and FIG. 3C is a cross-sectional view generally corresponding to a portion of a planarizing pad according to an exemplary embodiment of the invention with conditioning of the pad surface.
Figure 3C:
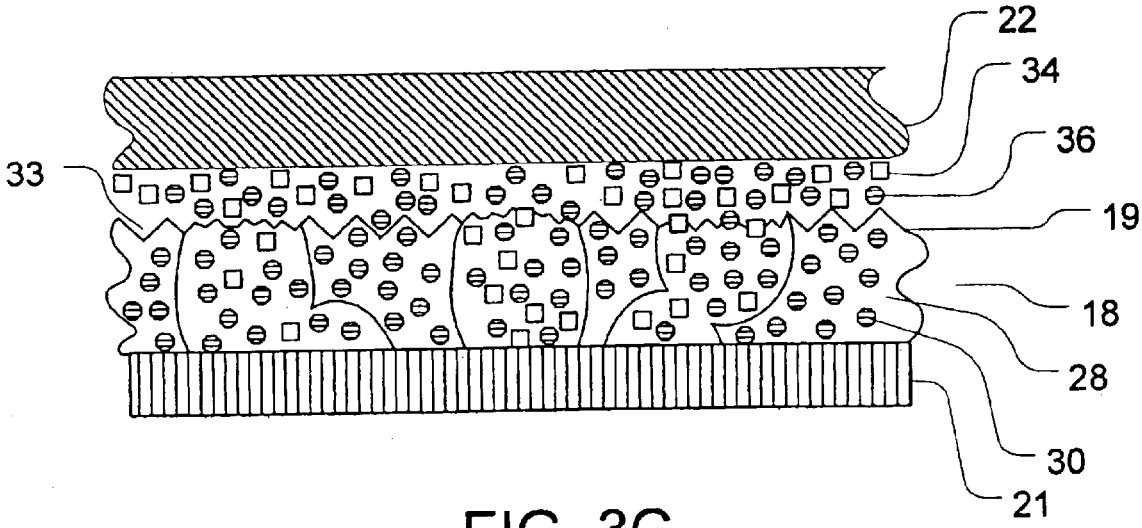

As illustrated in FIG. 3B, in a preferred embodiment, the fixed abrasive material 19 is provided as a substantially uniform layer on a substrate material 21 to form a fixed abrasive planarizing pad 18. In a preferred method, as illustrated in FIG. 3C, the material is conditioned to form nano-asperities 33 on the exposed major surface of the fixed abrasive material 19 and release free abrasive particles 36 and particles of the polymer matrix 34. The open cell construction of the fixed abrasive material 19 allows liquid and fine particles to flow into and through the fixed abrasive material and through the substrate material 21. The substrate material 21 can have a multi-layer and/or composite structure. Both the backing or substrate material 21 and the layer of fixed abrasive material 19 can be modified to include various channels or openings (not shown) to provide for process or equipment specific attachment, liquid flow and/or visual or physical access. As will be appreciated, FIGS. 3A–C are intended only to illustrate a simplified embodiment of the fixed abrasive material and a planarizing pad structure utilizing the fixed abrasive material according to the present invention for purposes of discussion and are, consequently, not drawn to scale and should not, therefore, be considered to limit the invention.

Figure 4A:
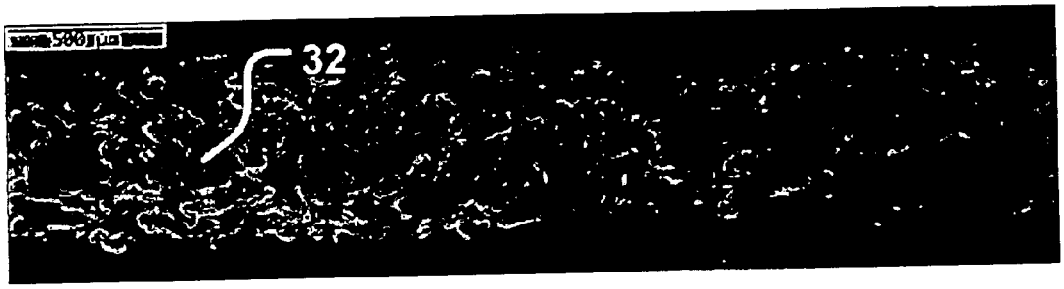
FIGS. 4A–B are SEM microphotographs of a fixed abrasive material manufactured according to an exemplary embodiment of the invention.
Figure 4B:
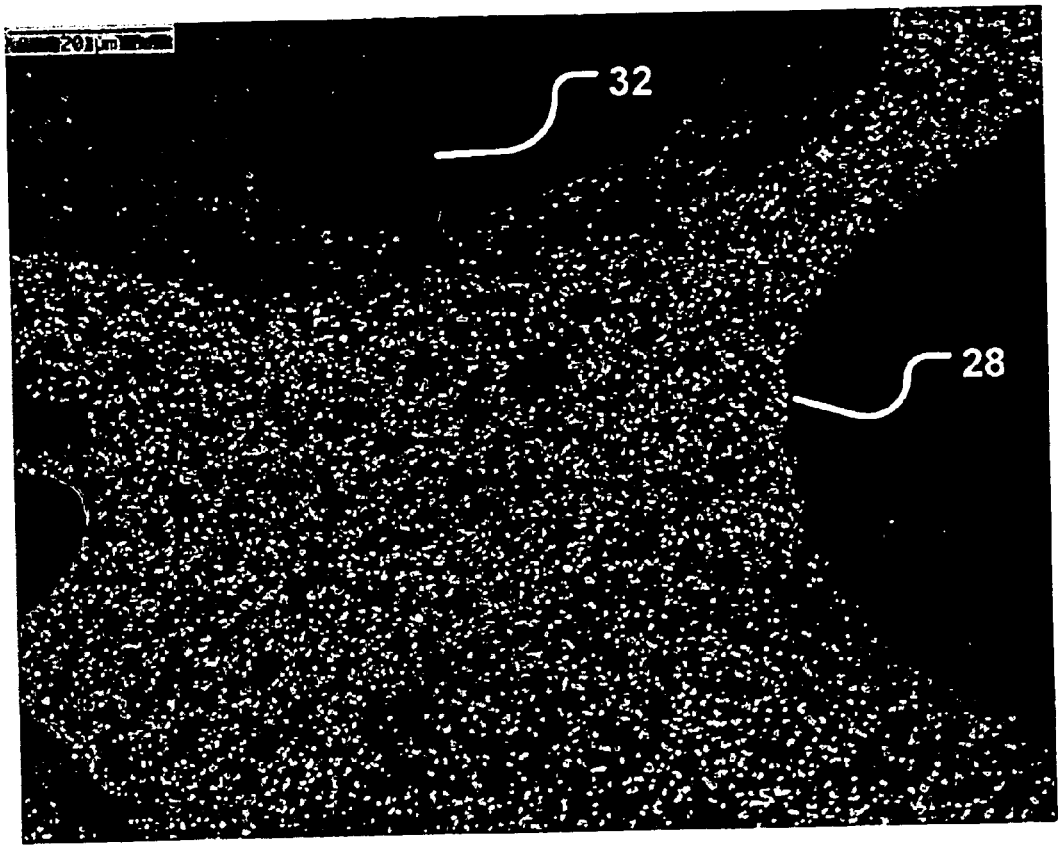
Figure 5A:
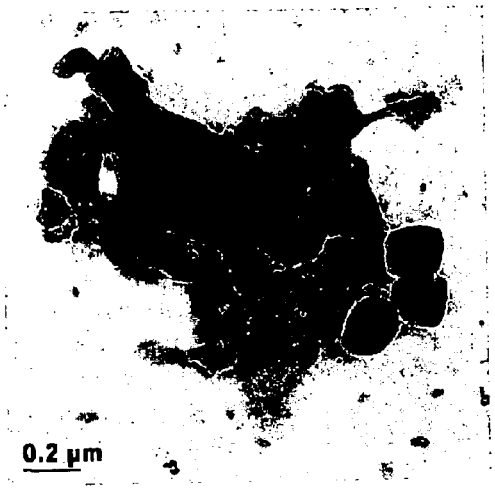
FIGS. 5A–D are SEM micrographs reflecting the range of particle composition produced by the conditioning of fixed abrasive pads according to an exemplary embodiment of the invention.
Figure 5B:
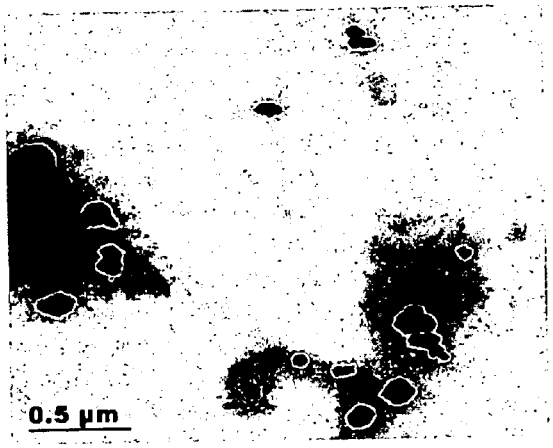
Figure 5C:
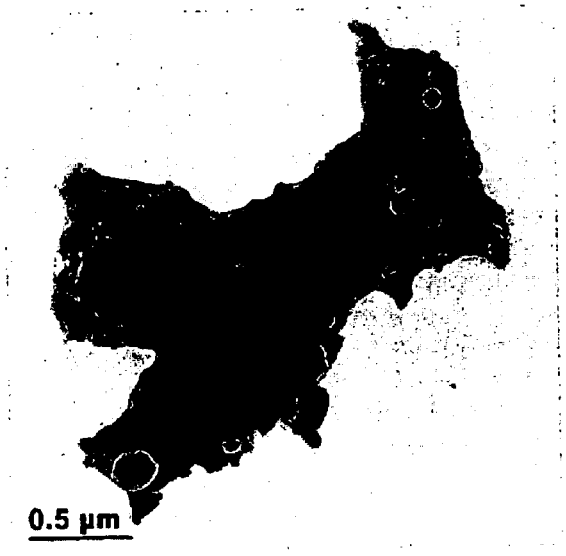
Figure 5D:
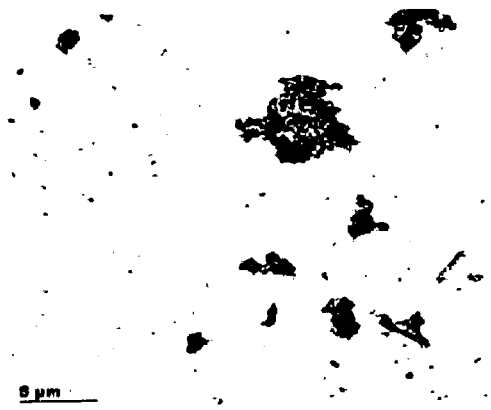
Figure 6A:
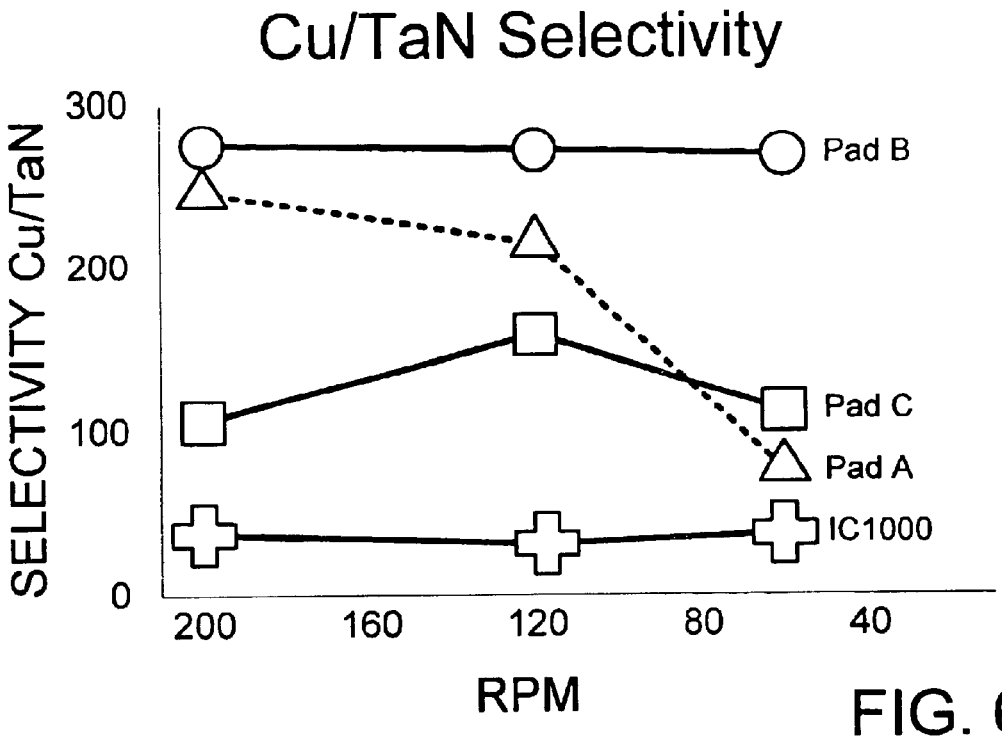
FIGS. 6A–B are graphs illustrating the Cu/TaN and Cu/TiN selectivity respectively of three exemplary pad compositions and a comparative conventional pad composition against the RPM utilized during the evaluation.
Figure 6B:
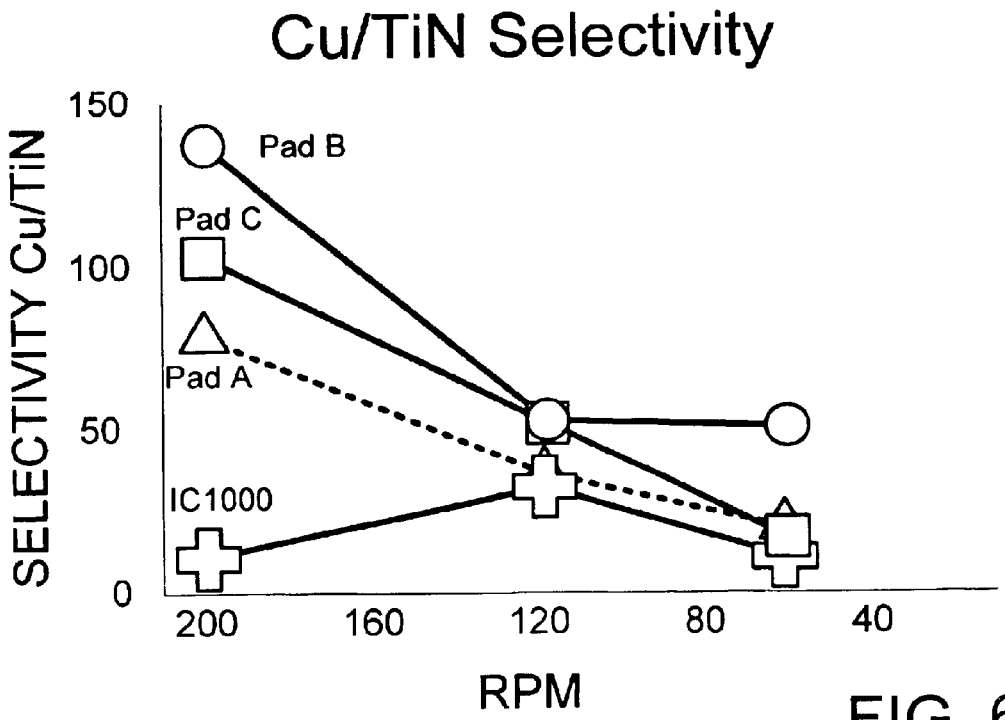

A fixed abrasive material useful for practicing the present invention was examined under a SEM to produce the micrographs provided as FIGS. 4A and 4B. FIG. 4A shows a surface of the fixed abrasive material under a relatively low magnification to illustrate the highly open structure of the fixed abrasive material utilized in the present invention. FIG. 4B shows a portion of the fixed abrasive material under much higher magnification to reveal details of the cell structure and illustrate the uniform distribution of the abrasive particles, i.e., the bright specks, throughout the polymeric composition forming the cell walls of the fixed abrasive material.

The fixed abrasive material may have a density from about 0.5 to about 1.5 g/cm$^3$, preferably from about 0.7 to about 1.4 g/cm$^3$, more preferably from 0.9 and about 1.3 g/cm$^3$, and most preferably between about 1.1 and 1.25 g/cm$^3$. The fixed abrasive material may have a Shore A hardness of from about 30 and about 90, preferably from about 70 to about 85, and more preferably from about 75 and about 85. The fixed abrasive material may have a percent rebound at 5 psi of from about 30 to about 90, preferably from about 50 to about 80, and more preferably from about 50 and about 75. The fixed abrasive material may have a percent compressibility at 5 psi of from about 1 to about 10%, preferably from about 2 to about 6%, more preferably from about 2 to about 4%. The fixed abrasive material may have a porosity of between about 5 and 60%, preferably between about 10 and 50%, and more preferably, between about 20 and 40%. The fixed abrasive material may have an average cell size between about 5 and 500 $\mu$m, preferably between about 30 and 300 $\mu$m, and more preferably between about 30 and 200 $\mu$m.

Planarization pads manufactured from a fixed abrasive material according to the present invention may be used to removed one or more materials from a major surface of a semiconductor substrate in a process by:

applying a carrier liquid to the polishing surface of a polishing pad, the polishing pad being formed from a fixed abrasive material having an open cell structure of a thermoset polymer matrix defining a plurality of interconnected cells and abrasive particles distributed throughout the polymer matrix;

causing relative motion between the substrate and the polishing surface of the polishing pad in a plane generally parallel to the major surface of the substrate while applying a force of not more than about 2.5 psi (0.18 kg/cm$^2$) or less tending to bring the major surface and the polishing surface into contact;

conditioning the polishing surface, thereby releasing abrasive particles from the fixed abrasive material to form free abrasive particles; and polishing the major surface of the substrate with the free abrasive particles to remove a portion of the material from the major surface of the substrate.

The steps of this method may be performed sequentially, or in a continuous process wherein one or more of the steps are performed substantially concurrently. In a preferred process, the steps of applying a carrier liquid, conditioning, and causing relative motion are performed substantially concurrently. The method may be performed with any of a variety of devices, including those devices conventionally used for CMP processes in the art.

The methods of this invention comprise the application of a carrier liquid to the polishing surface of the polishing pad. A carrier liquid is any liquid which is capable of wetting and facilitating the conditioning of the polishing pad. Carrier liquids may be solutions or emulsions, and are preferably aqueous. Carrier liquids or carrier emulsions may include, for example, wetting agents, suspension agents, pH buffering agents, oxidizers, chelating agents, oxidizing agents and/or abrasive particles. A preferred carrier liquid for oxide removal comprises deionized (DI) water and a suitable combination of acid or base materials so as to adjust the pH of the liquid to a pH of from about 4 to about 10, preferably from about 5 to about 8 and one or more other components.

Conversely, a preferred carrier liquid for the removal of metal such as copper (Cu) may comprise an oxidizer solution, for example about 5 wt % hydrogen peroxide, in combination with a chelating agent and one or more surfactants. Suitable chelating agents include aminocarboxylates such as ethylenediaminetetraacetic acid (EDTA), hydroxyethylethylenediaminetriacetic acid (HEDTA), nitrilotriacetic acid (NTA), diethylenetriaminepentaacetic acid (DPTA), ethanoldiglycinate and mixtures thereof.

The application of a carrier liquid to the polishing surface of the polishing pad is preferably conducted substantially concurrently with the conditioning of the polishing surface. The carrier liquid may be applied using any suitable means that will supply a sufficient quantity and distribution of the carrier liquid across the polishing surface of the pad. Such means include methods and apparatus similar to those known and used in the art for applying conditioning or planarization slurries.

Although a polishing pad faced with abrasive material fixed in a polymer matrix as detailed above may be capable of removing material from the surface of a substrate at a low rate during a CMP process, the material removal rate may be improved in a preferred embodiment by creating free abrasive particles through the in-situ conditioning of the polishing surface. In a preferred embodiment, the open cell structure of the fixed abrasive material reduces or eliminates the need for conventional "break-in" conditioning to prepare the polishing pad prior to polishing. Preferably, the free abrasive particles comprise a mixture of abrasive particles, composite abrasive/polymer particles and polymer particles that have been separated from the fixed abrasive material by the conditioning process. In a preferred method, the free abrasive particles combine with a carrier liquid to form a planarization slurry that cooperates with the planarization surface to remove the targeted material layer from the surface of a semiconductor substrate.

As reflected in the SEM micrographs in FIGS. 5A–D, the particles released from fixed abrasive material according to exemplary embodiments of the invention may include a mixture of abrasive particles, polymer particles and composite particles including abrasive particles still within a polymer matrix. This mixture of particles tends reduce the number and severity of scratches that contribute to the overall defectivity of the resulting polished wafer surface.

The conditioning step of this invention preferably comprises:

placing a conditioning surface of a conditioning element adjacent the polishing surface; and inducing relative motion between the conditioning element and the polishing pad in a plane generally parallel to the polishing surface while applying a force tending to bring the conditioning surface and the polishing surface into contact. It is anticipated that typically from about 0.01 to about 0.5 $\mu$m of the fixed abrasive material will be removed from the polishing surface during the conditioning step for each substrate that is polished, but this range may vary depending on at least the relative surface areas of the planarizing pad and the substrates being planarized, the number of substrates being planarized simultaneously, the composition and thickness of the material(s) being removed from the substrate and the contribution of the carrier liquid, if any, to the removal of the material(s) from the substrate.

The material removed from the polishing surface of the polishing pad by the conditioning will combine with the carrier liquid to form an in-situ slurry comprising between about 0.01 and 10 wt % solids, preferably between about 0.1 and 5 wt % solids, and more preferably, between about 0.1 and 2 wt % solids. The average polymer particle size within the in-situ slurry may be between about 1 $\mu$m and 25 $\mu$m and may typically be between about 0.1 $\mu$m and 10 $\mu$m, preferably between about 0.5 $\mu$m and 5 $\mu$m, and more preferably between about 0.5 $\mu$m and 2 $\mu$m. By forming the slurry in-situ, the exemplary embodiments of the invention avoid the difficulties associated with maintaining a separate slurry for use in a CMP process such as the need for agitation and the risk of agglomeration of the abrasive particles.

Conditioning elements typically comprise a device configured for attachment to conditioning equipment (e.g., a mechanical arm) with a substantially planar or cylindrical conditioning surface opposite the attachment point. The actual conditioning requires relative movement between the conditioning surface and the polishing surface as the surfaces are urged together by a compressive force or load. In many instances, both the conditioning surface and the polishing surface are rotated simultaneously with the conditioning surface also being moved across the polishing surface in a linear or arcuate fashion.

Conditioning elements are usually considerably smaller in diameter than the polishing pad they used to condition and may be generally configured as disks, rings or cylinders. The conditioning elements may include solid and or patterned surfaces and may include bristles or filaments for "brush" configurations. In order to condition substantially all of the polishing surface, the conditioning equipment may pass the conditioning element from the center of the polishing surface to the edge and back to the center (bi-directional conditioning) or may pass the conditioning element only from the center to the edge of the polishing pad (unidirectional conditioning).

If more than one pass of the conditioning element is necessary to achieve the desired polishing surface in a unidirectional system, the conditioning element is typically raised to avoid contact with the polishing surface, centered, lowered and again swept to the edge of the pad. Such unidirectional conditioning may also tend to sweep debris and other material off the polishing surface as the conditioning element moves to and perhaps past the edge of the polishing surface.

Conditioning elements may incorporate a wide range of shapes, particle type or types, particle size, surface topography, particle pattern, or modifications made to the element surface or particles. For example, the conditioning surface of the conditioning element may include grooves in a circular, linear, grid or combination pattern. Similarly, the conditioning particles may be arrayed on the conditioning surface circular, linear, grid, combination or random patterns and may incorporate more than one type or size of conditioning particle.

The conditioning surface of a conditioning element typically includes abrasive particles of sufficient hardness and size to abrade the polishing surface. The conditioning particles may include one or more of polymer, diamond, silicon carbide, titanium nitride, titanium carbide, alumina, alumina alloys, or coated alumina particles, with diamond particles being widely used. Conditioning particles may be provided on a conditioning surface using a variety of techniques including, for example, chemical vapor deposition (CVD), formed as a part of a substantially uniform conditioning material or may be embedded in another material. The manner in which the conditioning particles are provided on the conditioning surface need only be sufficient to enable the conditioning surface to have the desired effect on the surface being conditioned.

Many conditioning elements are provided as disks or rings and may be formed with diameters ranging from about 1 to about 16 inches (2.5 to 40.6 cm) and more commonly are provided in diameters between about 2 and 4 inches (5.1 and 10.2 cm). Diamond conditioner elements, specifically conditioner disks may be obtained from Dimonex, Inc. (Allentown, Pa.), 3M (Minneapolis, Minn.) and others. In those instances in which the conditioning elements are provided as rings, the width of the ring portion of the conditioning element may range from about 0.5 to 2 inches (1.3 to 5.1 cm).

The size, density and distribution of the conditioning particles provided on the conditioning surface will affect how much material the conditioning element removes during each pass of the surface being conditioned. As a result, conditioning particles generally exhibit an average diameter of from about 1 to 50 $\mu$m and more typically exhibit a diameter of from about 25 to 45 $\mu$m. Similarly, the number of conditioning particles provided on the conditioning surface (i.e., the particle density) tends to be between about 5 to 100 particles/mm$^2$ and more typically tends to be between about 40 to 60 particles/mm$^2$.

As one of ordinary skill in the art will appreciate, conditioning requires that the conditioning surface be brought into contact with the polishing surface while some compressive force or downward pressure is applied to maintain the necessary degree of contact between the surfaces. The amount of force applied will affect the conditioning process and is generally maintained within a range during the conditioning process. The down force applied to the conditioning element may be negligible and may range up to about 0.8 psi (about 0 to about 0.056 kg/cm$^2$) and may more typically be between about 0.4 psi (0.028 kg/cm$^2$) and about 0.7 psi (0.049 kg/cm$^2$).

Another variable in both break-in and in-process conditioning processes is the number of passes made by the conditioning surface across the polishing surface. As will be appreciated, if all other conditions remain the same, increasing the number of passes will increase the thickness of the material removed from the polishing surface. The goal in most conventional conditioning processes is to reduce the number of passes required to achieve the desired degree of conditioning of the polishing surface to increase the life of the polishing surface and increase the available production time.

In a preferred embodiment, unlike the conventional and prior art fixed abrasive polishing pads, a polishing pad according to the present invention does not include any macroscopic three-dimensional structures or alternating regions of distinctly different materials on the polishing surface. As illustrated in FIG. 3B, absent conditioning, such a polishing pad faced with the fixed abrasive material does not tend to release or to expose a sufficient quantity of abrasive particles and thus exhibits a relatively low material removal rate of a material layer from the surface of a semiconductor substrate.

As illustrated in FIG. 3C, however, conditioning the polishing surface of a polishing pad faced with fixed abrasive material according to the present invention releases a quantity of the fixed abrasive particles and polymer matrix. These released particles are then free to combine with the carrier liquid to form an in-situ planarizing slurry capable of removing material from a semiconductor substrate at an increased rate.

In one embodiment, the method of this invention further comprises the step of terminating or modifying the rate of polishing. Preferably, the termination or modification of the rate of polishing comprises one or more actions selected from a group consisting of:

terminating or modifying the relative motion of the substrate and the polishing pad;

removing the substrate from contact with the polishing pad;

terminating or modifying the conditioning of the polishing surface;

modifying the pH of the carrier liquid; and reducing the oxidizer concentration in the carrier liquid.

Preferably the pH of the carrier liquid is modified by adding a suitable acid or base to the liquid during the step of applying the conditioning liquid to the pad. In a preferred method, the polishing rate is decreased by increasing the pH of the carrier liquid, thereby reducing a rate at which oxide is removed from the major surface by at least about 50%. A preferred method for removing oxide from a major surface of a semiconductor comprises increasing the pH of the carrier liquid to pH 10 or more, preferably reducing the rate at which oxide is removed from the major surface is by at least about 75%.

Preferably the oxidizer concentration of the carrier liquid is reduced by slowing or terminating the addition of the oxidizer, such as hydrogen peroxide, to the carrier liquid, by switching to a less oxidizing carrier liquid, such as DI water, or by diluting the carrier liquid through the addition of excess DI water. In a preferred method, the polishing rate is decreased by reducing the oxidizer concentration of the carrier liquid, thereby reducing a rate at which metal, such as copper, is removed from the major surface of the semiconductor substrate by at least about 50%, and more preferably, by at least about 75%.

A preferred method for the CMP of a metal layer according to this invention comprises:

applying a carrier liquid to the polishing surface of a polishing pad, the polishing pad having an open cell structure of a thermoset polymer matrix defining a plurality of interconnected cells and abrasive particles distributed throughout the polymer matrix, and the carrier liquid having an oxidizer concentration;

causing relative motion between the substrate and the polishing pad in a plane generally parallel to the metal layer while applying a relatively light force, e.g., no more than about 2.5 psi (0.18 kg/cm$^2$) tending to bring the metal layer and the polishing surface into contact;

conditioning the polishing surface, thereby releasing free abrasive particles from the fixed abrasive material;

combining the carrier liquid and the free abrasive particles to form a planarizing slurry; and polishing the metal with the planarizing slurry to remove a portion of the metal from the substrate.

The methods of this invention also afford a method of selectively removing a metal layer and an underlying barrier layer from the surface of the substrate in which the barrier layer is removed from the major surface of the semiconductor substrate at a first rate and the metal layer is removed from the major surface at a second rate wherein the second rate is at least four times the first rate and is preferably more than about ten times the first rate.

The following exemplary examples are provided to illustrate the present invention. The examples are not intended to limit the scope of the present invention and should not be so interpreted. All percentages are by weight unless otherwise noted.

Exemplary Pad Composition A

An exemplary polyurethane, composition A, was prepared by combining:

80 parts WITCOBOND A-100 (WITCO Corp.);

20 parts WITCOBOND W-240 (WITCO Corp.);

5 parts surfactant (consisting of 3 parts STANFAX 320, 1 part STANFAX 590, and 1 part STANFAX 318) (Para-Chem Southern Inc.);

6.25 parts ACUSOL 810A (as a viscosity modifier/thickener) (Rohm & Haas); and 70 parts 500 nm ceria particles to form an aqueous dispersion (all parts reflecting dry weight). The polyurethane dispersion was then allowed to stand for approximately one hour to stabilize the viscosity at about 12,240 cps. The polyurethane dispersion was then frothed using an OAKES frother to produce a froth having a density of approximately 948 grams per liter and applied to a polycarbonate substrate to a thickness of about 1.5 mm. The froth was then cured for 2 hours at 70° C., 2 hours at 125° C., and 2 hours at 150° C. to form a foam product comprising a fixed abrasive material having a foam density between about 0.75 and 0.85 g/cm$^3$.

Exemplary Pad Composition B

Another exemplary polyurethane composition, composition B, was prepared by combining:

100 parts WITCOBOND W-240;

5 parts surfactant (consisting of 3 parts STANFAX 320, 1 part STANFAX 590, and 1 part STANFAX 318);

6 parts ACUSOL 810A (as a viscosity modifier/thickener); and 70 parts 500 nm ceria particles to form an aqueous dispersion. The polyurethane dispersion was then allowed to stand for approximately one hour to stabilize the viscosity at about 9400 cps. The polyurethane dispersion was then frothed using an OAKES frother to produce a froth having a density of approximately 835 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a foam density between about 0.75 and 0.85 g/cm$^3$.

Exemplary Pad Composition C

Another exemplary polyurethane composition, composition C, was prepared by combining:

100 parts UD-220 (Bondthane Corp.);

5 parts surfactant (consisting of 3 parts STANFAX 320, 1 part STANFAX 590, and 1 part STANFAX 318);

6 parts ACUSOL 810A (as a viscosity modifier/thickener); and 70 parts 500 nm ceria particles to form an aqueous dispersion. The polyurethane dispersion was then allowed to stand for approximately one hour to stabilize the viscosity at about 13,380 cps. The polyurethane dispersion was then frothed using an OAKES frother to produce a froth having a density of approximately 960 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a foam density between about 0.75 and 0.85 g/cm$^3$.

With regard to the specific components identified above in connection with the exemplary fixed abrasive materials, WITCOBOND A-100 is an aqueous dispersion of an aliphatic urethane/acrylic alloy, WITCOBOND W-240 is an aqueous dispersion of an aliphatic urethane, UD-220 is an aqueous dispersion of an aliphatic polyester, ACUSOL 810A is an anionic acrylic copolymer, STANFAX 318 is an anionic surfactant comprising sodium sulfosuccinimate used as a foam stabilizer, STANFAX 320 is an anionic surfactant comprising ammonium stearate used as a foaming agent, and STANFAX 519 is a surfactant comprising a di-(2-ethylhexyl) sulfosuccinate sodium salt used as a wetting/penetrant agent.

Cu Polishing Tests

Sample planarizing pads having a diameter of approximately 6 inches (approximately 15.25 cm) were manufactured using the polyurethane dispersions described above in connection with the exemplary compositions A, B and C and from a conventional IC1000™ (Rodel Inc.) polishing pad. After mounting the sample planarizing pads on a CMP polishing device, a 70:30 mixture of an abrasive-free slurry, specifically Hitachi's HS-C430-A3 slurry and a 30 wt % hydrogen peroxide solution was supplied to the surface of the polishing pad for the duration of the polishing process to produce a solution having an initial composition comprising about 9 wt % $H_2O_2$.

A series of 2-inch (approximately 5 cm) test wafers were then polished on the wetted and conditioned pad. The test wafers used included blanket Cu test wafers having a nominal Cu layer thickness of approximately 12,000 Å (for a copper weight of about 0.0206 g) and blanket TaN wafers having a nominal TaN layer thickness of 1000 Å (for a TaN weight of about 0.0028 g).

As reflected below in Table 1 (Cu) and Table 2 (TaN), the test wafers were polished for 10 minutes using either a conventional 4 psi (27.6 kPa) downforce or a reduced 1.5 psi (6.9 kPa) downforce and rotation speeds of 60, 120 or 200 rpm. After the polishing was completed, the test wafers were weighed to determine the mass of the layer that had been removed. In each case, the planarizing pads were subjected to a uniform in-situ conditioning process throughout the duration of the polishing process.

The CMP device utilized in this exemplary example provided for wafer and platen rotation rates from 60–200 rpm at loads of 0.5–4 psi (0.035–0.28 kg/cm$^2$). The sample pads were mounted on a SUBA-IV (Rodel) foamed polymer layer attached to the platen. No break-in conditioning was applied to the sample pads before the start of this evaluation, but continuous in-situ diamond conditioning with a four-inch (10.2 cm) ATI conditioning disk conditioning disk rotating at 60 rpm with a 0.6 psi (0.042 kg/cm$^2$) load applied was utilized to release abrasive, polymer and composite particles from the polishing surface of the sample planarization pads for the duration of this evaluation. As reflected below in Table 1, the loads applied to the test wafers during the polishing test procedures were 4 psi (0.28 kg/cm$^2$) and 1.5 psi (0.11 kg/cm$^2$) at rotation speeds of 60, 120 and 200 rpm. With respect to the TaN removal rates using the IC1000 abrasive pad, the removal rates at 120 and 60 was simply too low to be measured accurately with the equipment utilized during the test. The reported removal rates were then calculated from the time required to remove the target material substantially completely from the test wafer or from the weight of the material removed during the particular test run.

TABLE 1

| Pad Type | RPM | Downforce (PSI)/(kPa) | Removal Rate (Å/min) |
|---|---|---|---|
| A | 200 | 4.0/27.6 | 1500 |
| A | 120 | 4.0/27.6 | 1160 |
| A | 60 | 4.0/27.6 | 870 |
| A | 200 | 1.5/10.3 | 1439 |
| A | 120 | 1.5/10.3 | 1293 |
| A | 60 | 1.5/10.3 | 874 |
| B | 200 | 4.0/27.6 | 1124 |
| B | 120 | 4.0/27.6 | 1130 |
| B | 60 | 4.0/27.6 | 925 |
| B | 200 | 1.5/10.3 | 1625 |
| B | 120 | 1.5/10.3 | 1567 |
| B | 60 | 1.5/10.3 | 1200 |
| C | 200 | 4.0/27.6 | 1200 |
| C | 120 | 4.0/27.6 | 1030 |
| C | 60 | 4.0/27.6 | 849 |
| C | 200 | 1.5/10.3 | 1328 |
| C | 120 | 1.5/10.3 | 950 |
| C | 60 | 1.5/10.3 | 717 |
| IC1000 | 200 | 4.0/27.6 | 1636 |
| IC1000 | 120 | 4.0/27.6 | 1384 |
| IC1000 | 60 | 4.0/27.6 | 594 |
| IC1000 | 200 | 1.5/10.3 | 250 |
| IC1000 | 120 | 1.5/10.3 | 419 |
| IC1000 | 60 | 1.5/10.3 | 425 |

TABLE 2

| Pad Type | RPM | Downforce (PSI)/(kPa) | Removal Rate (Å/min) (approx) |
|---|---|---|---|
| A | 200 | 4.0/27.6 | 163 |
| A | 120 | 4.0/27.6 | 84 |
| A | 60 | 4.0/27.6 | 57 |
| A | 200 | 1.5/10.3 | 4 |
| A | 120 | 1.5/10.3 | 4 |
| A | 60 | 1.5/10.3 | 8 |
| IC1000 | 200 | 4.0/27.6 | 133 |

TABLE 2-continued

| Pad Type | RPM | Downforce (PSI)/(kPa) | Removal Rate (Å/min) (approx) |
|---|---|---|---|
| IC1000 | 120 | 4.0/27.6 | 129 |
| IC1000 | 60 | 4.0/27.6 | 97 |
| IC1000 | 200 | 1.5/10.3 | 4 |
| IC1000 | 120 | 1.5/10.3 | — |
| IC1000 | 60 | 1.5/10.3 | — |

The removal rates observed for both exemplary pad composition A and the IC1000 for both the Cu and TaN films were then used to calculate the selectivity obtained under the stated conditions. The selectivity ratios calculated as a function of the amount of material removed by the exemplary polishing pads and method is presented below in Table 3. It should be noted that the amount of material removed from the test wafers, particularly with respect to the barrier layer materials, is sufficiently low that its precise quantification was difficult with the instruments used in the present evaluation. The reported selectivities should, therefore, be considered as a general indication of the range of performance that may be experienced when utilizing the exemplary methods and fixed abrasive materials according to the invention.

As reflected in the data presented in Table 1, polishing a copper layer with each of the exemplary pad compositions substantially maintained or increased the material removal rate even with a reduction in the down force of approximately 60%. This unusual and unexpected behavior performance that is generally contrary to the behavior expected and documented in conventional abrasive pads such as the comparative IC1000. This increased selectivity allows a metal CMP process to be operated under conditions that result in both improved selectivity and satisfactory removal rates, thus improving the processing margin for such processes.

TABLE 3

| Pad Type | RPM | Downforce (PSI)/(kPa) | Selectivity Cu/TaN Removed Thickness Ratio (approximate) |
|---|---|---|---|
| A | 200 | 4.0/27.6 | 9 |
| A | 120 | 4.0/27.6 | 14 |
| A | 60 | 4.0/27.6 | 15 |
| A | 200 | 1.5/10.3 | 368 |
| A | 120 | 1.5/10.3 | 331 |
| A | 60 | 1.5/10.3 | 112 |
| IC1000 | 200 | 4.0/27.6 | 12 |
| IC1000 | 120 | 4.0/27.6 | 11 |
| IC1000 | 60 | 4.0/27.6 | 6 |
| IC1000 | 200 | 1.5/10.3 | 64 |
| IC1000 | 120 | 1.5/10.3 | — |
| IC1000 | 60 | 1.5/10.3 | — |

The exemplary fixed abrasive pad compositions and the associated low-pressure CMP processes may be used in the planarization of a range of materials utilized in semiconductor manufacturing as well as other polishing or planarization processes. It is anticipated that pad compositions according to the invention may be used to remove the various material layers including the metals, metal oxides, metal nitrides, semiconductors, semiconductor oxides and semiconductor nitrides that are typically found in semiconductor processing. Other applications may include planar and non-planar polishing processes unrelated to semiconductor device manufacture including, for example, polishing hard drive materials, lens and mirrors.

The principles and modes of operation of this invention have been described above with reference to certain exemplary and preferred embodiments. However, it should be noted that this invention may be practiced in manners other than those specifically illustrated and described above without departing from the scope of the invention as defined in the following claims.

We claim:

1. A method of removing material from a major surface of a substrate comprising:

applying a carrier liquid to a polishing surface of a polishing pad, the polishing pad including a fixed abrasive material having an open cell structure of a thermoset polymer matrix defining a plurality of interconnected cells and abrasive particles distributed throughout the polymer matrix;

causing relative motion between the substrate and the polishing pad in a plane generally parallel to the major surface of the substrate while applying a first force, the first force tending to bring the major surface and the polishing surface into contact;

conditioning the polishing surface by causing relative motion between a conditioning element and the polishing pad in a plane generally parallel to the major surface of the substrate while applying a second force, the second force tending to bring the conditioning element and the polishing surface into contact, thereby releasing free abrasive particles from the fixed abrasive material; and polishing the major surface of the substrate with the free abrasive particles to remove a portion of the material from the major surface of the substrate;

wherein the first force is no greater than about 2.5 psi.

2. A method of removing material from a major surface of a substrate according to claim 1, wherein:

the first force is no greater than about 1.5 psi.

3. A method of removing material from a major surface of a substrate according to claim 1, wherein:

the first force is no greater than about 1 psi.

4. A method of removing material from a major surface of a substrate according to claim 1, wherein:

the material includes at least one material selected from a group consisting of Cu, W, WN, Ta, TaN, Ti, TiN, Ru and RuN.

5. A method of removing material from a major surface of a substrate according to claim 1, wherein:

the free abrasive particles include at least two types of particles selected from abrasive particles, composite abrasive/polymer particles and polymer particles.

6. A method of removing material from a major surface of a substrate according to claim 1, wherein:

the free abrasive particles mix with the carrier liquid to form a planarization slurry.

7. A method of removing material from a major surface of a substrate according to claim 1, wherein:

applying a carrier liquid;

causing relative motion between the substrate and the polishing pad;

conditioning the polishing surface; and polishing the major surface of the substrate are performed substantially simultaneously.

8. A method of removing material from a major surface of a substrate according to claim 7, wherein:

conditioning the polishing surface is performed substantially continuously with the second force being no greater than about 1 psi.

9. A method of removing material from a major surface of a substrate according to claim 1, wherein:

the material being removing includes layers of both Cu and a metal nitride;

the Cu is removed from the substrate at a first removal rate; and the metal nitride is removed from the substrate at a second removal rate, further wherein a ratio of the first removal rate to the second removal rate is at least 10:1.

10. A method of removing material from a major surface of a substrate according to claim 9, wherein:

the metal nitride is TiN or TaN; and the first removal rate is at least 800 Å/minute.

11. A method of removing material from a major surface of a substrate according to claim 10, wherein:

the ratio between the first removal rate and the second removal rate is at least 20:1.

12. A method of removing material from a major surface of a substrate according to claim 10, wherein:

the material removal rate is at least 70% of a high pressure removal rate obtained using a first force of between 3 psi and 5 psi.

13. A method of removing material from a major surface of a substrate according to claim 1, wherein:

the carrier liquid includes at least one component selected from a group consisting of acids, bases, chelating agents and surfactants.

14. A method of removing material from a major surface of a substrate according to claim 13, wherein:

the material includes a soft metal formed over a barrier material; and the carrier liquid includes an oxidizer.

15. A method of removing material from a major surface of a substrate according to claim 14, wherein:

the oxidizer includes at least about 5 wt % $H_2O_2$.

16. A method of removing material from a major surface of a substrate according to claim 14, wherein:

the soft metal is copper or an alloy thereof; and the barrier material is a metal nitride.

17. A method of removing material from a major surface of a substrate comprising:

applying a carrier liquid to a polishing surface of a polishing pad, the polishing pad including a fixed abrasive material having an open cell structure of a thermoset polymer matrix defining a plurality of interconnected cells and abrasive particles distributed throughout the polymer matrix wherein the cells in the fixed abrasive material have an average cell diameter, the average cell diameter being less than 250 $\mu$m and the abrasive particles have an average particle size of less than about 2 $\mu$m, and include one or more particulate materials selected from a group consisting of alumina, ceria, silica, titania and zirconia;

causing relative motion between the substrate and the polishing pad in a plane generally parallel to the major surface of the substrate while applying a first force, the first force tending to bring the major surface and the polishing surface into contact;

conditioning the polishing surface by causing relative motion between a conditioning element and the polishing pad in a plane generally parallel to the major surface of the substrate while applying a second force, the second force tending to bring the conditioning element and the polishing surface into contact, thereby releasing free abrasive particles from the fixed abrasive material; and polishing the major surface of the substrate with the free abrasive particles to remove a portion of the material from the major surface of the substrate;

wherein the first force is no greater than about 2.5 psi.

18. A method of removing a material from a major surface of a substrate according to claim 17, wherein:

the abrasive particles constitute between about 20 weight percent and about 70 weight percent of the fixed abrasive material.

19. A method of removing a material from a major surface of a substrate according to claim 18, wherein:

the abrasive particles have an average particle size of no more than 1 $\mu$m.

20. A method of removing material from a major surface of a substrate comprising:

applying a carrier liquid to a polishing surface of a polishing pad, the polishing pad including a fixed abrasive material having an open cell structure of a thermoset polymer matrix defining a plurality of interconnected cells and abrasive particles distributed throughout the polymer matrix;

causing relative motion between the substrate and the polishing pad in a plane generally parallel to the major surface of the substrate while applying a first force, the first force tending to bring the major surface and the polishing surface into contact;

conditioning the polishing surface by causing relative motion between a conditioning element and the polishing pad in a plane generally parallel to the major surface of the substrate while applying a second force, the second force tending to bring the conditioning element and the polishing surface into contact, thereby releasing free abrasive particles from the fixed abrasive material and removing an average of from about 0.01 to about 0.5 $\mu$m of the fixed abrasive material from the polishing surface for each substrate polished; and polishing the major surface of the substrate with the free abrasive particles to remove a portion of the material from the major surface of the substrate;

wherein the first force is no greater than about 2.5 psi.

21. A method of removing a material from a major surface of a substrate according to claim 1, wherein:

the fixed abrasive material has a density between about 0.5 and about 1.2 gram per $cm^3$;

a Shore A hardness between about 30 and about 90;

a percent rebound at 5 psi of between about 30 and about 90; and a percent compressibility at 5 psi of between about 1 and 10.

22. A method of removing a material from a major surface of a substrate according to claim 21, wherein:

the fixed abrasive material has a density between about 0.7 and about 1.0 gram per $cm^3$;

a Shore A hardness between about 70 and about 85;

a percent rebound at 5 psi of between about 50 and about 80; and a percent compressibility at 5 psi of between about 2 and 6.

23. A method of removing a material from a major surface of a substrate according to claim 22, wherein:

the fixed abrasive material has a density between about 0.75 and about 0.95 gram per $cm^3$;

a Shore A hardness between about 75 and about 85;

a percent rebound at 5 psi of between about 50 and about 75; and a percent compressibility at 5 psi of between about 2 and 4.

* * * * *